US006428060B1

(12) United States Patent
Metz

(10) Patent No.: US 6,428,060 B1
(45) Date of Patent: Aug. 6, 2002

(54) LATCH MECHANISM

(75) Inventor: Joseph R. Metz, Ridgefield, CT (US)

(73) Assignee: Norco, Inc., Georgetown, CT (US)

( * ) Notice: Subject to any disclaimer, the term of this patent is extended or adjusted under 35 U.S.C. 154(b) by 0 days.

(21) Appl. No.: 09/476,962

(22) Filed: Jan. 3, 2000

(51) Int. Cl.[7] ..... E05C 3/16; E05C 5/00
(52) U.S. Cl. ..... 292/227; 292/67
(58) Field of Search ..... 292/57, 64, 67, 292/204, 207, 227, 359; 70/379 R

(56) References Cited

U.S. PATENT DOCUMENTS 4,556,244 A * 12/1985 Bisbing ..... 292/65
5,192,098 A 3/1993 Barnes et al.
5,409,272 A * 4/1995 McCormack ..... 292/66
5,961,162 A * 10/1999 Glaser et al. ..... 292/198

* cited by examiner

*Primary Examiner*—S. Joseph Morano
*Assistant Examiner*—Andrew D. Wright
(74) *Attorney, Agent, or Firm*—Wall, Marjama & Bilinski, LLP

(57) ABSTRACT

A latching mechanism for securing a panel member to a support member. The mechanism includes a rotary assembly that is flush mounted in the panel and which contains a radially extended arm that is rotatable into and out of latching engagement with the support member. The rotary mechanism further contains a key that is spring loaded into a locked position when the arm is in a latched position. The key further contains lugs that are maintained in a guideway to control the movement of the key. The guideway directs the key downwardly in an axial direction when the key is depressed moving the key out of the locked position into an unlocked position. When the key is in the unlocked position, the rotary assembly can be turned to bring the latching arm to an unlatched position. The guideway is arranged to hold the key in a depressed condition any time the latch mechanism is not latched.

14 Claims, 3 Drawing Sheets

LATCH MECHANISM

BACKGROUND OF THE INVENTION

This invention relates to an improved latch mechanism for securing a panel to a support structure.

In U.S. Pat. No. 5,192,098 there is described a security type latching mechanism that is mounted upon a panel to secure the panel to a support member. The mechanism contains a latching arm attached to a rotor assembly that rotates the arm between a latched and an unlatched position. When the arm is in an attached condition, the rotor assembly is locked in place by an actuator to prevent the arm from moving into an unlatched position. The actuator can be depressed in the rotor assembly to unlock the assembly and thus allow the latching arm to be moved to an unlatched position.

Although the latch mechanism disclosed in the above noted '098 patent is a decided improvement in the art, it nevertheless contains a relatively large number of interrelated parts that makes assembly of the mechanism difficult. The latch mechanism also protrudes outwardly from the panel, thus restricting its use to applications where flush mounting is not of concern. Lastly, the mechanism does not provide the user with a discernable indication of whether or not the latch is fully latched. Under certain conditions this uncertainty as to whether or not the panel is securely closed can cause problems.

SUMMARY OF THE INVENTION

It is therefore an object of the present invention to improve latching mechanisms for securing panels or doors to a supporting structure.

A further object of the present invention is to provide a flush mounted latching mechanism for a panel or door that will lessen the danger of the mechanism becoming entangled with objects and help streamline the supporting structure.

A still further object of the invention is to provide a latching mechanism for a panel that will give clear indication to the user that the mechanism is in a fully latched condition.

Another object of the present invention is to reduce the number of parts needed to install and operate a flush mounted security latching mechanism.

These and other objects of the present invention are attained by a latching mechanism for securing a panel or the like to a support structure. The mechanism includes a stationary cylindrical housing flush mounted in the outer wall of the panel which passes through the panel. A bore is passed axially through the housing and a pair of opposed circumferentially disposed slots are passed through the wall into the bore. A latching pawl contains a collar that surrounds the housing and which supports a radially extended latching arm that can be rotated into and out of latching engagement with the support member. A rotor is rotatably mounted within the housing bore and contains a blind hole passing upwardly along the axis of the rotor through the bottom wall of the rotor. A square shaped restricted opening is passed through the top wall of the rotor and communicates with the blind hole. A pin is passed through the rotor, the circumferential slots in the housing and the collar of the latching pawl so that the rotor and latching pawl can turn in the housing slots about the axis of the housing to move the latching arm between a fully latched position and an unlatched position. A key is slidably contained within the blind hole of the rotor and contains an axially aligned slotted hole through which the pin passes. A portion of the key extends beneath the rotor and has a pair of opposed lugs that are adapted to ride in guideways formed in the housing bore. The guideway contains an upper axially disposed section and a lower circumferentially disposed section. A spring is adapted to urge the key upwardly along the upper guideway section into a locked position wherein a head situated upon the top of the key is received in the restricted opening in the rotor. Depressing the key against the biasing force of the spring brings the key into an unlocked position wherein the lugs are aligned with the circumferential section of the guideway. At this time, the rotor and the latching pawl can be turned as a unit to bring the latching arm into a fully unlocked position. Anytime the latching arm is in a position other than a fully latched position, the key will be depressed thereby providing the user with a visual indication that the arm is not latched.

BRIEF DESCRIPTION OF THE DRAWING

For a fuller understanding of the nature and objects of the invention, reference should be made to the following detailed description of a preferred mode of practicing the invention, read in connection with the accompanying drawings, in which.

DETAILED DESCRIPTION OF THE INVENTION

Figure 1:
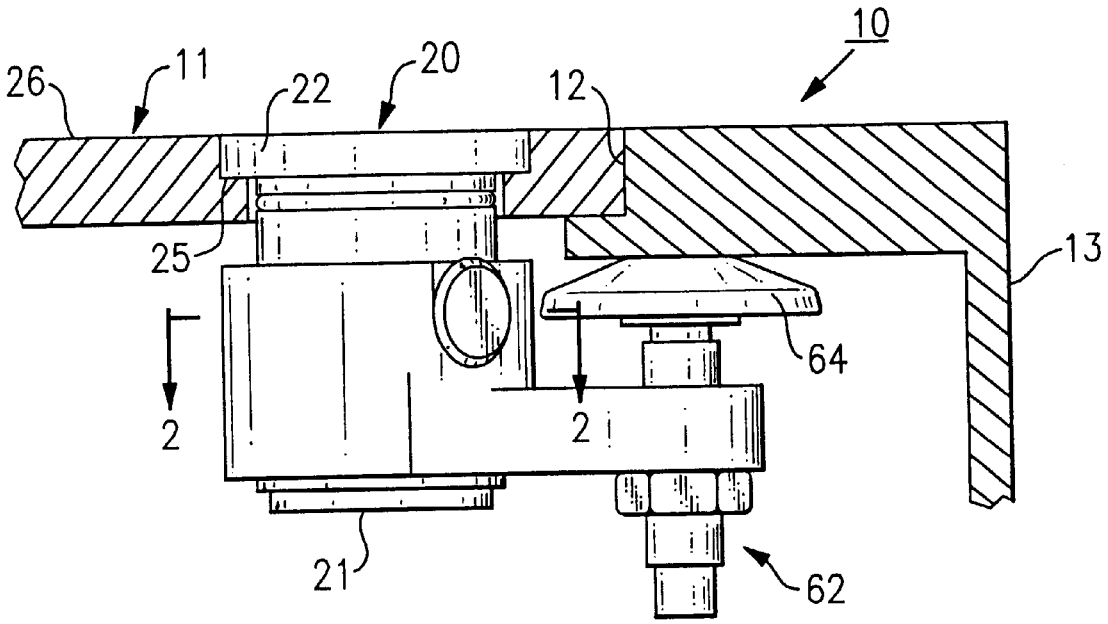
FIG. 1 is a side elevation of the latch mechanism showing the mechanism flush mounted in a panel and being latched with the panel support structure.
Figure 2:
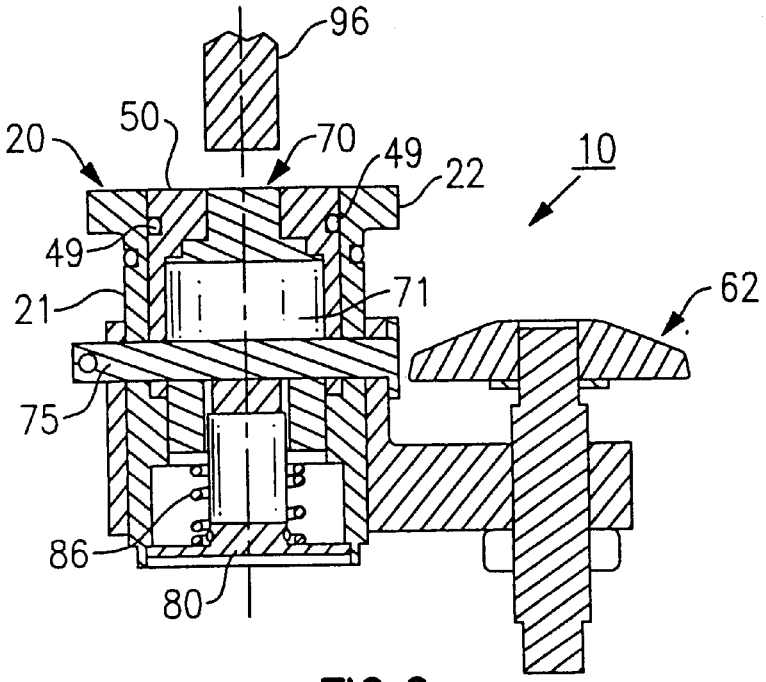
FIG. 2 is a sectional view taken along lines 2—2 in FIG. 1.
Figure 3:
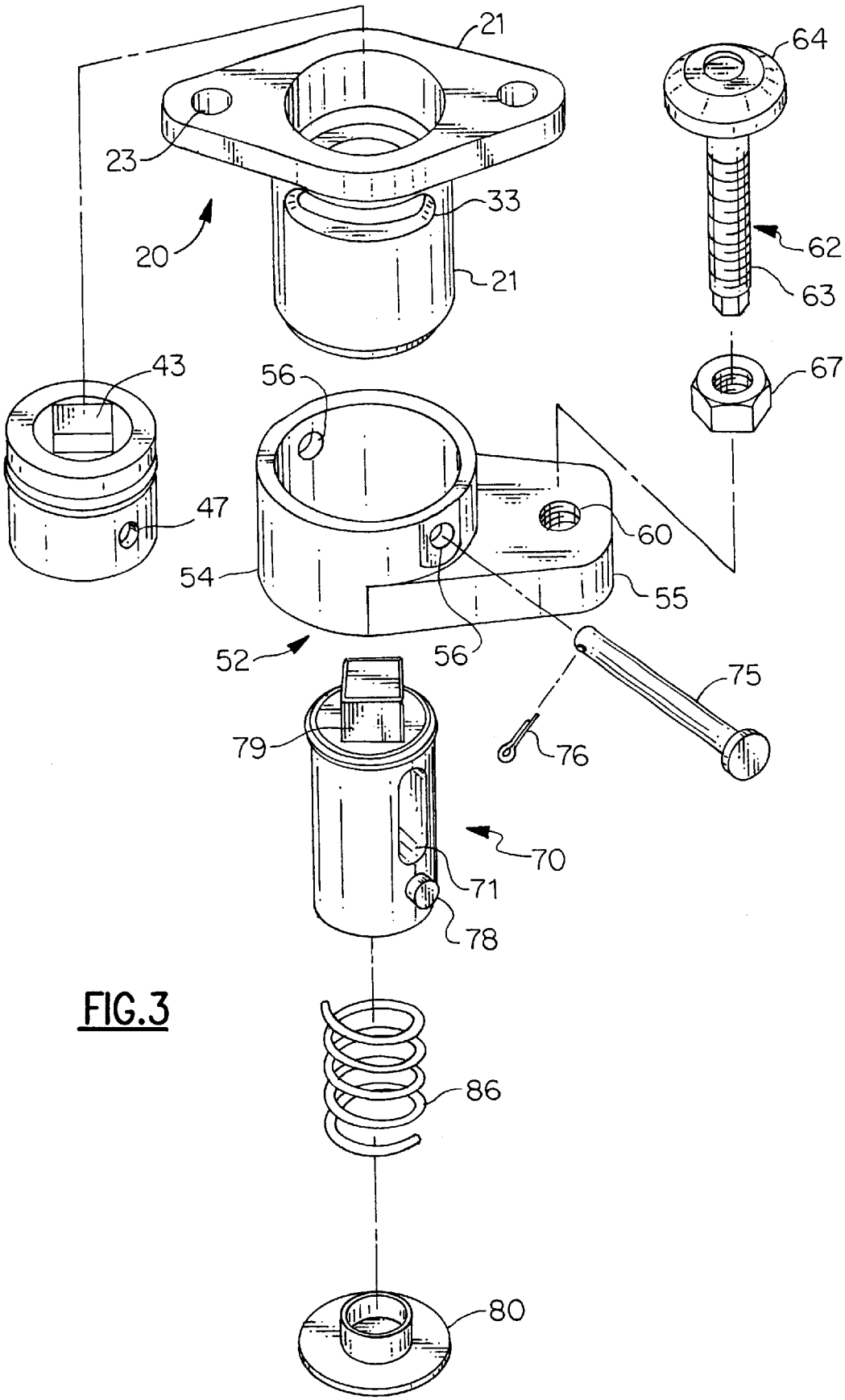
FIG. 3 is an enlarged exploded view in perspective showing the component parts of the latch mechanism.
Figure 10:
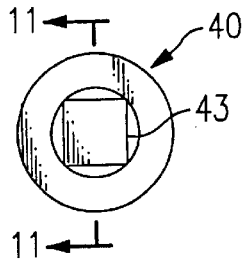
FIG. 10 is a top view of the rotor shown in FIG. 9.
Figure 9:
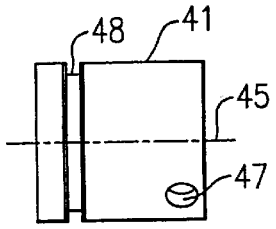
FIG. 9 is a side elevation of the latch rotor.
Figure 11:
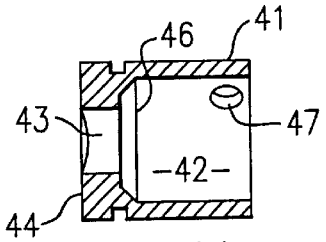
FIG. 11 is a sectional view taken along lines 11—11 in FIG. 10.
Figure 4:
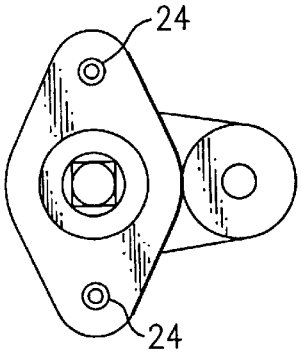
FIG. 4 is a top view of the latch mechanism showing the latch in a locked position.
Figure 5:
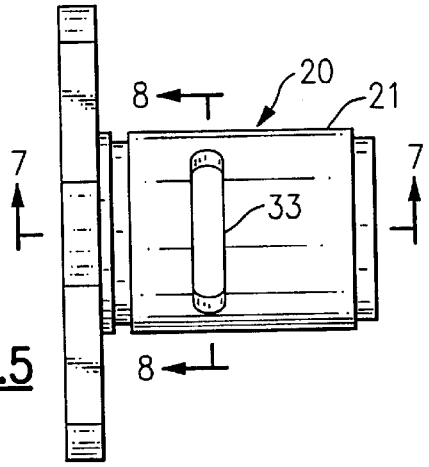
FIG. 5 is a side elevation of the latch housing.
Figure 6:
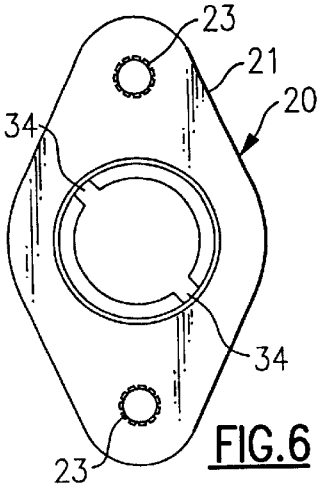
FIG. 6 is a top view of the latch housing.
Figure 7:
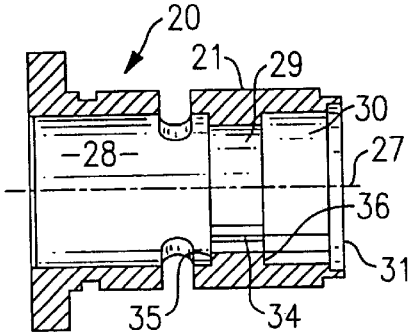
FIG. 7 is a sectional view taken along lines 7—7 in FIG. 5.
Figure 8:
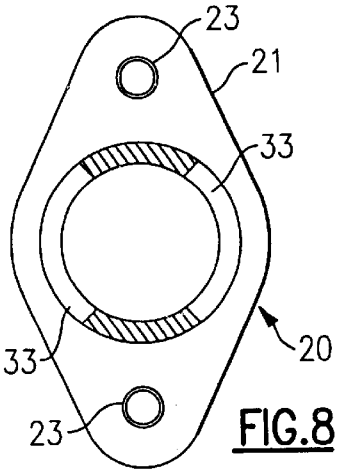
FIG. 8 is a sectional view taken along lines 8—8 in FIG. 5.

Turning initially to FIGS. 1–3, there is illustrated a latching mechanism, generally referenced 10, embodying the teachings of the present invention. The mechanism is illustrated in FIG. 1 mounted in a panel 11 that is contained in a recessed opening 12 in a support structure 13. The latching arm 55 of the mechanism is shown in an extended or latching position beneath the support structure to secure the panel tightly within the recessed opening. Typically, a number of latches will be spaced about the periphery of the panel so that each latching mechanism uniformly shares the latching force exerted against the support structure which is required to safely maintain the panel in securely closed and locked condition.

Although the latching mechanism is shown mounted upon the panel in FIG. 1, it should be obvious to one skilled in the art that the mechanism can be mounted in the support structure and arranged to secure the panel in an inwardly opening recess without departing from the teachings of the present invention.

The latch mechanism 10 contains a main housing 20 which includes a cylindrical body 21 and a radially expanded top flange 22. As best illustrated in FIGS. 5–8, the flange is generally oblong shaped and contains an opposed pair of mounting holes 23. The flange is adapted to be received in a complementary recess 25 formed in the top wall 26 of the panel to bring the top surface of the flange flush with the top surface of the panel in assembly. Threaded fasteners 24 are passed through the mounting holes and threaded into the panel thus securing the housing to the panel. In certain applications, the mounting holes may be countersunk and flathead screws used to secure the housing in place, thus providing the panel with a relatively smooth outer surface.

The housing contains a bore passing axially therethrough along the center line 27. The bore contains an upper region 28, a narrower mid region 29 and an expanded bottom region 30 that has a diameter that is about equal to that of the upper region. A recess 31 is formed in the bottom entrance to the housing bore for receiving an end cap 80 (FIG. 3) therein which closes the bottom of the housing in assembly. A pair of opposed circumferentially extended slotted holes 33—33 are passed through the housing wall, both of which pass into the upper region of the housing bore. A pair of opposed axially disposed channels 34—34 (FIG. 6) are passed downwardly through the side wall of the narrow mid-region of the housing bore. An upper shoulder 35 is provided at the top entrance to the mid region of the bore and a similar lower shoulder 36 is provided at the bottom exit to the mid region.

A cylindrical rotor 40 is mounted for rotation in the upper region of the bore formed in the stationary housing. The rotor has a blind hole 42 that passes upwardly through the bottom of the rotor body 41 to a given depth and a square shaped restricted opening 43 is formed in the top wall 44 of the rotor body. Both the restricted open and the blind hole are coaxially aligned along the center axis 45 of the rotor and communicate through a necked down chamfered region 46. A pair of opposed holes 47—47 pass radially through the side wall of the rotor body. An annular recess 48 is formed in the outer wall of body 41 and an O-ring 49 (FIG. 2) is mounted in the recess to prevent fluids from passing between the rotor and the housing.

In assembly, the rotor is mounted in the upper region of the housing bore with the bottom of the rotor resting upon the upper shoulder 35 of the bore. When the rotor is seated upon the shoulder, its top surface 50 is flush with the housing flange and the holes 47—47 are radially aligned with the circumferential slots formed in the housing. The rotor forms a close sliding fit with the upper section of the housing bore and is able to rotate about the central axis 27 of the housing.

A latching pawl generally referenced 52 (FIG. 3) is rotatably supported upon the outside of the housing. The pawl includes a tubular collar 54 that forms a close sliding fit with the outer wall of the housing body. A radially extended latching arm 55 is integrally joined to the collar so that it can rotate about the housing with the collar. The collar contains a pair of opposed holes 56—56 that pass radially through the collar wall and which are aligned in assembly with the circumferential slots 33 formed in the housing wall and the holes 47 formed in the rotor body.

A threaded hole 60 is formed in the outboard end of the locking arm and, as illustrated in FIGS. 1–3, an adjustable locking member 62 is threaded into the hole. The locking member contains a threaded shank 63 having an expanded cap 64, which is arranged to pass under the support member 13 (FIG. 1) in friction locking contact with the underside of the support member. The cap of the locking member is preferably formed of a resilient material that can deform against the support structure to provide for a tight locking fit between the latch and the support member. A lock nut 67 is threaded onto the shank of the locking member and is tightened securely against the bottom of the latching arm when the head of the locking member is set at a desired height.

Figure 14:
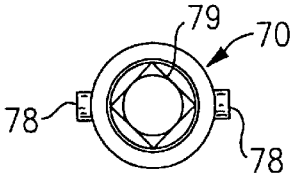
FIG. 14 is a top view of the key shown in FIG. 12.
Figure 12:
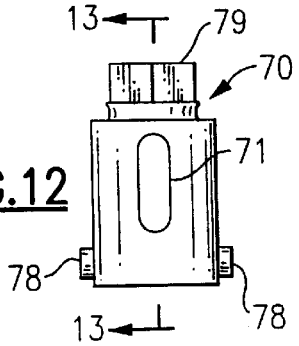
FIG. 12 is a side elevation of the latch key.
Figure 13:
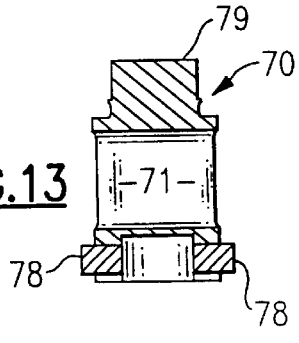
FIG. 13 is a sectional view of the key taken along lines 13—13 in FIG. 12.

A cylindrical key 70 is slidably contained within the blind hole 42 of the rotor 40 so that the key can move axially within the rotor. As illustrated in FIGS. 12–14, an axially disposed slotted hole 71 is passed diametrically through the key. The slotted hole, in assembly, is aligned with the holes 47 formed in the rotor as well as with the circumferential slots 33 in the housing and the holes 56 in the latching pawl collar. An elongated pin 75 (FIG. 3) is passed through the aligned holes and slots to cojoin the parts in assembly. As should now be evident, the key is capable of rotating with the rotor while at the same time being able to slide axially within the blind hole of the rotor. The axial length of the slot determining the amount of axial travel afforded the key.

An end cap 80 is retained in the recess 31 formed in the bottom of the latch housing to close the lower region of the housing bore. The end cap can be held in assembly by any suitable means such as spot welding or the like.

The key extends downwardly below the bottom of the rotor body and has a pair of radially extended lugs 78—78 on the bottom section whereof which, in assembly, ride in the axial channels 34 formed in the mid region of the latch housing bore. A head 79 having a square configuration that compliments the restricted hole 43 formed in the top wall of the rotor is situated on the top of the key in axial alignment with the key body. The head is slidably received within the restricted hole in the rotor. A compression spring 86 is mounted between the end cap and the bottom of the key that urges the key upwardly in the channels 34 to position the head within the restricted hole. The top surface of the head is coplanar with the top of the rotor when the latching arm is in the fully latched position. At this time, the key is in a locked position and the latching arm cannot move out of the fully latched position.

A special square shanked unlocking tool 96 is used to unlock the key and move the latching pawl to an unlatched position. A square shaped shank 97 is insertable into the restricted opening in the rotor and the tool is capable of depressing the key downwardly in the rotor to a depth sufficient so that the lugs clear the axial channels 34 in the housing. At this time, the lugs are positioned inside the lower region of the housing bore below the lower shoulder 36 in the lower bore region, thus unlocking the key. The rotor, and thus the latching pawl, is free to rotate about the axis of the housing. Turning the tool thus rotates the pawl arm into an unlatched position while at the same time, captures the rotor lugs beneath the shoulder 36. The circumferential slots in the housing determine the amount of circumferential travel that is afforded the latch collar and thus the latching arm. The amount of travel is preferably 90°. When the pin is located at one extreme end of the slots 33, the arm is in a fully latched position and when the pin is moved to the other extreme position in the slots, the latching arm is in an unlatched position. As can be seen, anytime the key lugs are captured beneath the shoulder 36, the key will be held in a depressed position thereby clearly indicating to the user that the latch mechanism is unlatched. The amount of downward travel afforded the key is controlled by the axially disposed slot 71 in the key. When the top of the slot is bottomed against pin 75, the key is in an unlocked position and the lugs are free to pass beneath the shoulder 36 in the latch housing.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A latch mechanism for removably securing a panel member to a support member that includes a housing stationarily mounted in one of said members and having a cylindrical body that passes downwardly through said one member, said housing containing a bore that passes downwardly into said one member along the axis of said housing;

a latching arm rotatably mounted upon the outside of said housing body that is movable between a latched position in engagement with said other member and an unlatched position out of engagement with said other member;

a rotor mounted within the housing bore for rotation about the axis of said housing, said rotor having a hole passing axially therethrough;

connecting means for coupling said rotor to said latching arm so that the rotor and the latching arm rotate together about the axis of said housing between the latched and unlatched positions, a cylindrical key mounted for rotation within said rotor, said key being slidably contained within the hole formed in said rotor for movement between a first raised locked position wherein the top of the key is in coplanar alignment with the top of the rotor and a lower unlocked position wherein the top of the key is recessed within said rotor, at least one radially extended lug mounted on said key that is adapted to ride in an axial channel in the wall of said bore when the latching arm is in a latched position and for guiding the key axially between the locked and the unlocked positions; and said channel passing through an annular shoulder formed in said bore so that said at least one lug can be rotated beneath the shoulder wherein said latching arm is rotated from the latched to the unlatched position.

2. The latch mechanism of claim 1 that further contains a spring means for urging the key upwardly toward the locked position.

3. The latch mechanism of claim 2 wherein said hole in said rotor contains an upper section having at least one planar wall that opens into a wider lower section, and said key contains an axially extended head that is contained in the upper section of the hole in said rotor when the key is in a locked position.

4. The latch mechanism of claim 1 wherein said latching arm further includes a tubular collar that is rotatably supported upon the body of said housing and an adjustable latching member mounted upon the distal end of said arm for engaging said other member.

5. The latch mechanism of claim 4 wherein said adjustable latching member contains an elongated shank threaded into the distal end of said latching arm and a cap mounted upon the upper end of said shank for engaging said other member.

6. The latch mechanism of claim 1 wherein said housing further includes an upper end flange wherein the top surface of said flange is coplanar with the top surfaces of said rotor and said key when the key is in a locked position.

7. A latch mechanism for securing a panel to a support member that includes a housing stationarily mounted in one of said members and having a cylindrical body containing a bore that passes through said housing along the central axis of said body and a pair of opposed circumferentially disposed slots that passes radially through the wall of said body into said bore;

a latching pawl having a collar surrounding said housing body for rotation about the axis of said housing body, said collar containing a radially extended arm for passing into latching engagement with said one member when the collar is in a first position and into unlatching engagement when the collar is rotated into a second position;

a cylindrical rotor rotatably mounted inside said bore, said rotor having a blind hole passing upwardly through the bottom of said rotor and a smaller opening formed in the top wall of the rotor that passes into said hole;

a key slidably mounted in the blind hole of said rotor, said key having an axially extended slot passing radially therethrough;

a pin passing through said collar, the circumferential slots in the housing, the rotor and the axially extended slot in said key, whereby the latching pawl, the rotor and the key rotate together about the axis of said housing;

said key having a lower section that extends downwardly below the lower end of said rotor and;

a pair of opposed lugs radially extending from said lower section of the key, said lugs riding in axially disposed channels formed in the housing bore so that said key can move axially between a raised locked position wherein said rotor and latching pawl are prevented from rotating and a lower unlocked position wherein said lugs are free to rotate beneath an annular shoulder formed in said housing bore.

8. The latching mechanism of claim 7 wherein said housing has an upper end flange that is flush mounted in a recess formed in said panel.

9. The latching mechanism of claim 8 that further includes a spring means for biasing said key upwardly into said locked position.

10. The latching mechanism of claim 9 wherein said rotor contains a restricted opening in the top wall that passes into said blind hole, said restricted opening having at least one flat axially extended surface, said key having a head that complements the restricted opening and which is seated in said opening when the key is in the locked position.

11. The latching mechanism of claim 10 wherein the top surface of said flange and the top surfaces of said rotor and said key are all in coplanar alignment when the key is in a locked position and wherein the top surface of said key is recessed in the restricted opening when the latching arm is in an unlatched position.

12. The latching mechanism of claim 11 that further includes an adjustable latching member mounted in the distal end of said latching arm.

13. The latching mechanism of claim 12 wherein said adjustable latching member includes an elongated shank that is threaded into the distal end of said latching arm and a cap that is arranged to move into latching engagement with said support member.

14. The latching mechanism of claim 13 that further includes a removable bottom wall for closing the bore of said housing and a compression spring mounted in a loaded condition between the bottom wall of the housing and the lower section of said key.

* * * * *